US011254405B1

(12) United States Patent
Marjan et al.

(10) Patent No.: US 11,254,405 B1
(45) **Date of Patent: *Feb. 22, 2022**

(54) OAR ASSEMBLY FOR A PADDLEBOARD

(71) Applicants: Marjaneh Marjan, San Clemente, CA (US); Manouchehr Marjan, Irvine, CA (US)

(72) Inventors: Marjaneh Marjan, San Clemente, CA (US); Manouchehr Marjan, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/313,647

(22) Filed: May 6, 2021

(51) Int. Cl.
*B63H 16/04* (2006.01)
*B63H 16/06* (2006.01)
*B63B 32/40* (2020.01)

(52) U.S. Cl.
CPC ..... *B63H 16/04* (2013.01); *B63B 32/40* (2020.02); *B63H 16/06* (2013.01)

(58) Field of Classification Search
CPC .. B63H 16/04; B63H 2016/043; B63H 16/06; B63H 2016/063; B63H 16/067; B63H 16/073; B63H 2016/085; B63H 16/10; B63H 16/102; B63H 16/105; B63H 16/107; B63H 16/12; B63H 16/14; B63H 16/20; B63H 32/40
USPC ..... 440/101–110
See application file for complete search history.

(56) References Cited

U.S. PATENT DOCUMENTS

| | | | | |
|---|---|---|---|---|
| 3,156,934 | A * | 11/1964 | Kashewjohn | B63H 16/102 440/103 |
| 6,890,226 | B2 * | 5/2005 | Wang | B63B 32/00 440/17 |
| 7,267,586 | B1 * | 9/2007 | Murphy | B63H 1/32 440/32 |
| 9,533,741 | B2 * | 1/2017 | Parkinson | B63B 32/40 |
| 10,207,783 | B1 * | 2/2019 | Marjan | B63B 32/77 |
| 10,647,396 | B2 * | 5/2020 | Marjan | B63B 32/00 |

* cited by examiner

*Primary Examiner* — Daniel V Venne

(57) ABSTRACT

An oar assembly for a paddleboard is disclosed herein. The oar assembly according to one embodiment, allows the user to propel in a forward as well as a reverse direction. The oar assembly comprises a shaft having a top end and a bottom end. A first geared coupler having a first toothed surface extends from the bottom end of the shaft. A second geared coupler having a second toothed surface is configured to couple to the first geared coupler. An oar blade extends from the second geared coupler. A pair of brackets is configured for assembly on the shaft, the first geared coupler, and the second geared coupler. According to one aspect, a meshing of the first toothed surface with the second toothed surface facilitates hingeable movement between the first geared coupler and the second geared coupler, and thereby between the shaft and the oar blade.

15 Claims, 5 Drawing Sheets

OAR ASSEMBLY FOR A PADDLEBOARD

FIELD

The present invention relates generally to paddleboards, and more specifically, to a kit for converting a board into a stand-up paddle board that a user can conveniently propel in forward or reverse direction.

BACKGROUND

Nowadays, stand up paddle boarding also known as SUP has developed as an alternative style of paddle boarding compared to the conventional paddle boarding sports such a surfing, kayaking, and the like. Stand up paddle boarding may be understood as a workout that combines surfing with kayaking and canoeing. As the name suggests, stand up paddle boards are maneuvered in a standing or upright position. As a form of workout, SUP can provide a person with an intensive full body work out while breaking the monotony of a typical gym and adding a fun adrenaline inducing feel to the workout. Typical stand up paddle boards are propelled with the use of a single paddle, which may be a single ended paddle or a double ended paddle according to the preference of the user. Propelling the paddle board with a double ended paddle is done in a manner similar to kayaking, whereas propelling the paddle board with a single ended paddle is done in a manner similar to canoeing.

A disadvantage of the SUP boards with a single paddle is that they are extremely difficult to maneuver because the user has to constantly adjust the body balance to counter the unbalance caused by the constantly moving the paddle from side to side. To this end, SUP boards have been developed in the art that involve the use of two paddles with one attached to the paddleboard on each side. Having a paddle at each side of the paddleboard eliminates the need to shift the user's body weight as in the case of single paddle SUP boards, thus making it easier to propel the SUP board while maintaining decent balance.

A disadvantage of some of the conventional SUP boards with two paddles is that it is typically difficult to propel the SUP board in the reverse direction due to the paddles being attached to the boards, which limits the range of movement of the paddles with respect to the boards. In some SUP boards, the user must change the orientation of their bodies and turn around on the SUP board, which is extremely inconvenient to do while maintaining balance on the SUP board.

Therefore, there exists a previously unappreciated need for a new and improved paddle for the SUP boards that facilitates the functionalities mentioned above and addresses the shortcomings of the prior art. It is to these ends that the present invention has been developed.

SUMMARY

To minimize the limitations in the prior art, and to minimize other limitations that will be apparent upon reading and understanding the present specification, the present invention describes a packaging container, which includes an auxiliary lid for sealing the packaging container in a substantially air-tight manner once the packaging container has been opened or unsealed for maintaining the quality of the food item.

An oar assembly for a paddleboard, in accordance with an embodiment of the present subject matter, comprises a shaft having a top end and a bottom end. A first geared coupler having a first toothed surface extends from the bottom end of the shaft. A second geared coupler has a second toothed surface and is configured to couple to the first geared coupler. An oar blade extends from the second geared coupler. A pair of brackets are configured for assembly on the shaft, the first geared coupler, and the second geared coupler. According to one aspect, a meshing of the first toothed surface with the second toothed surface facilitates hingeable movement between the first geared coupler and the second geared coupler, and thereby between the shaft and the oar blade.

In some embodiments, the oar assembly further comprises a first hinged joint configured between the first geared coupler and the pair of brackets, wherein the first hinged joint allows the hingeable movement between the first geared coupler and the second geared coupler.

In some embodiments, the oar assembly further comprises a first hinged joint configured between the shaft and the pair of brackets, wherein so the first hinged joint allows the hingeable movement between the first geared coupler and the second geared coupler.

In some embodiments, the oar assembly further comprises a second joint including a bolt and an aperture. The second joint is configured between the shaft and the pair of brackets, wherein the placement of the bolt in the aperture locks the hingeable movement of the first geared coupler with respect to the second geared coupler.

In some embodiments, the oar assembly further comprises a third joint configured between the pair of brackets and the second coupler, wherein the third joint includes an aperture and a screw.

In some embodiments, the second geared coupler includes a pair of laterally extending pins to be received within the aperture of the third joint for facilitating hinged movement of the second geared coupler in between the pair of brackets.

In some embodiments, the oar assembly further comprises at least one oar blade stoppers extending from the pair of brackets and attached to the oar blade.

These and many other advantages and features of the present invention are described herein with specificity so as to make the present invention understandable to one of ordinary skill in the art, both with respect to how to practice the present invention and how to make the present invention.

BRIEF DESCRIPTION OF DRAWING

The aspects and other features of the subject matter will be better understood with regard to the following description, appended claims, and accompanying figures. In the figures, the left-most digit(s) of a reference number identifies the figure in which the reference number first appears. The use of the same reference number in different figures indicates similar or identical items.

DETAILED DESCRIPTION

In the following discussion that addresses a number of embodiments and applications of the present invention, reference is made to the accompanying drawings that form a part hereof, where depictions are made, by way of illustration, of specific embodiments in which the invention may be practiced. It is to be understood that other embodiments may be utilized, and changes may be made without departing from the scope of the present invention.

Figure 1:
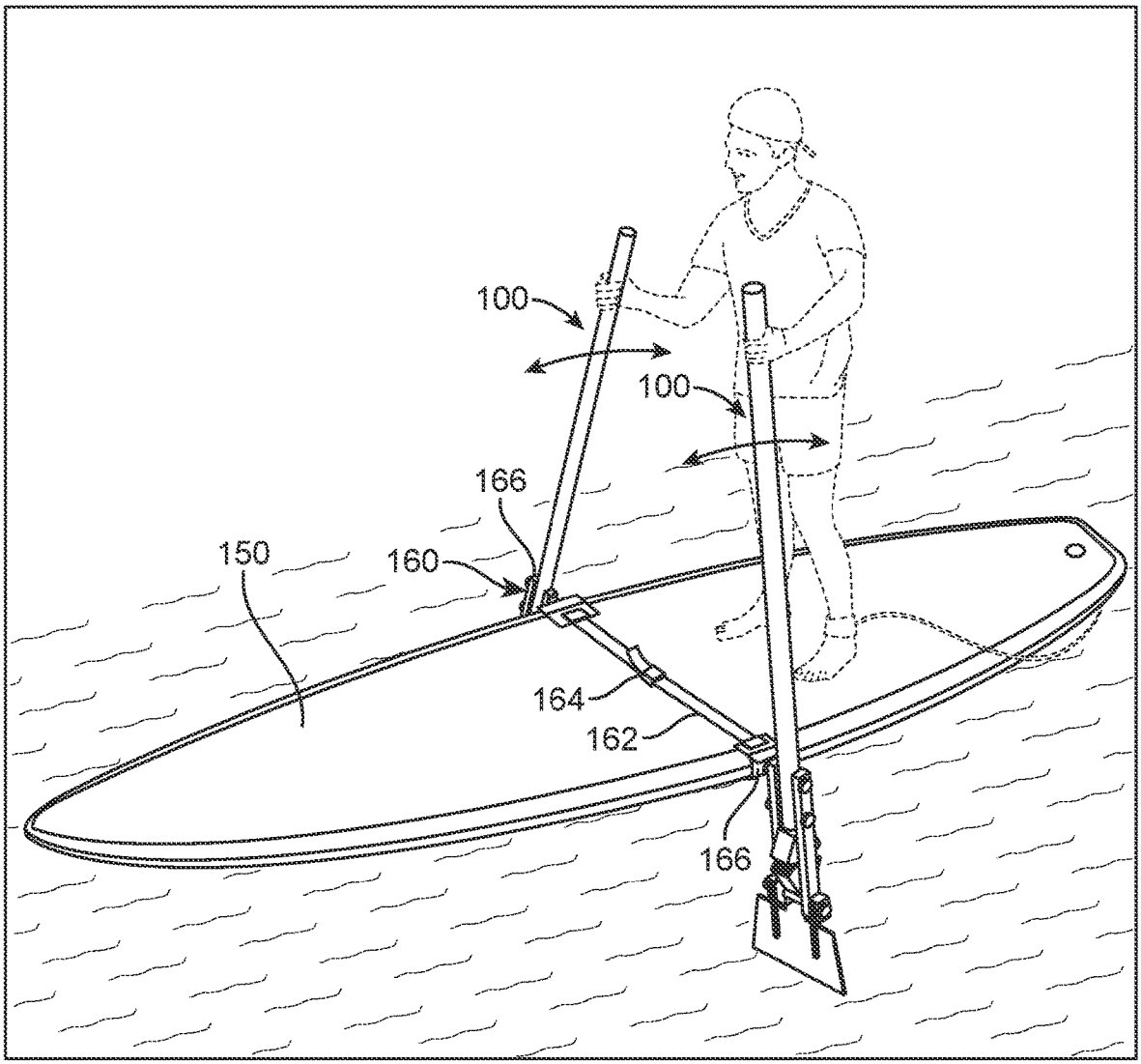
FIG. 1 illustrates a perspective view of an oar assembly assembled onto a paddleboard, according to an embodiment of the present subject matter.

FIG. 1 illustrates a perspective view of a pair of oar assemblies 100 assembled onto a paddleboard 150, according to an embodiment of the present subject matter. One oar assembly 100 is configured on each side of the paddleboard 150. An attachment apparatus 160 is used to attach the oar assemblies 100 onto each side of the paddleboard. The attachment apparatus 160 comprises a strap 162 that goes around the paddle paddleboard and secured thereto via a fastener 164. Board support members 166 are also provided on each side of the paddleboard 150, wherein the board support members 166 are secured onto the paddleboard 150 via the strap 162. The attachment apparatus 160 may further include means such as, for example, a ball and socket joint for coupling to the oar assemblies 100 to facilitate pivotal movement of the oar assemblies 100 with respect to the paddleboard 150. It is to be noted that the attachment apparatus 160 is only one exemplary way to attach the oar assemblies 100 to the paddleboard 150. The oar assemblies 100, in accordance with an embodiment of the present subject matter, may be attached to paddleboard 150 in any other manner using any other device other than the attachment apparatus 160.

Figure 2A:
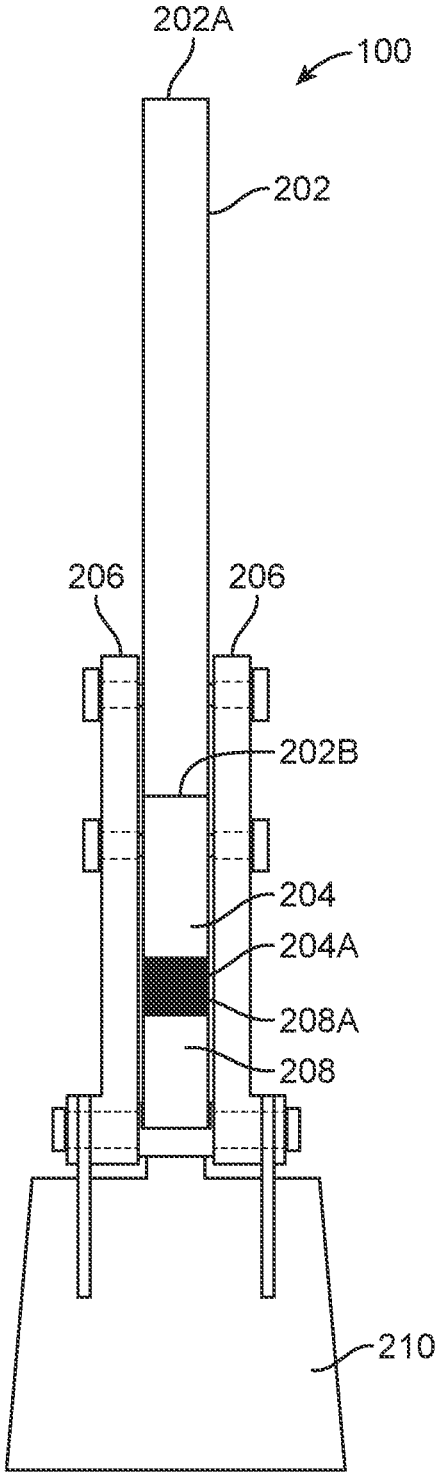
FIG. 2A illustrates a front view of the oar assembly, according to an embodiment of the present subject matter.
Figure 2B:
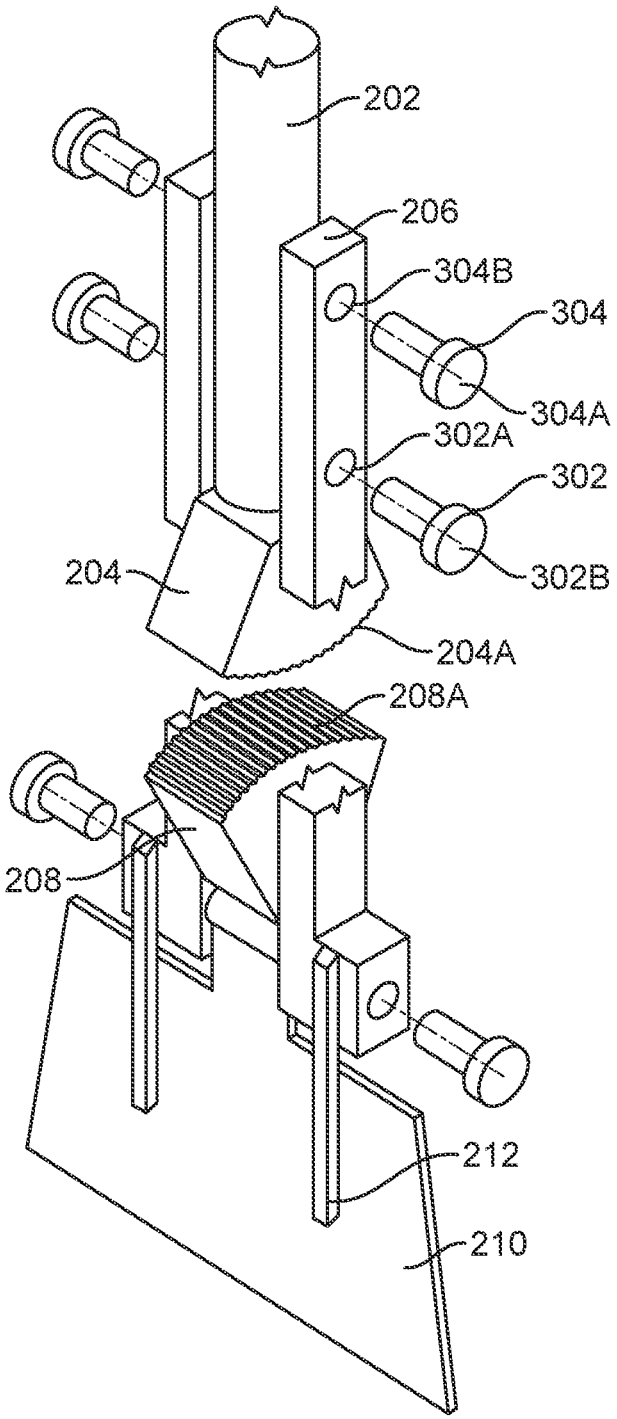
FIG. 2B illustrates partial perspective view of the oar assembly, according to an embodiment of the present subject matter.

FIG. 2A illustrates a front view of the oar assembly 100, according to an embodiment of the present subject matter. FIG. 2B illustrates partial perspective view of the oar assembly, according to an embodiment of the present subject matter. Reference hereinafter is directed to FIG. 2A and FIG. 2B. The oar assembly 100 comprises a shaft 202. The shaft 202 has a top end 202A and a bottom end 202B. The oar assembly 100 further comprises a first geared coupler 204 extending from the bottom end 202B of the shaft 202. In accordance with one embodiment, the shaft 202 and the first geared coupler 204 are integral components. In another embodiment, the shaft 202 and the first geared coupler 204 may be discreet components that may be coupled together mechanically via fasteners or snap fit formations. The first geared coupler 204 has a first toothed surface 204A. In accordance with an embodiment of the present subject matter, the first toothed surface 204A has an arcuate profile. The oar assembly 100 further comprises a pair of brackets 206. The pair of brackets 206 are coupled to the shaft 202 as well as the first geared coupler 204.

The oar assembly 100 further comprises a second geared coupler 208 having a second toothed surface 208A. Similar to the first toothed surface 204A, the second toothed surface 208A also has an arcuate profile. More specifically, the first toothed surface 204A and the second toothed surface 208A have complementary profiles configured to facilitate meshing thereof.

The second geared coupler 208 is also coupled to the pair of brackets 206. More specifically, the shaft 202, the first geared coupler 204, and the second geared coupler 208 are held together in an assembled state via the pair of brackets 206. The oar assembly 100 further comprises an oar blade 210 extending from the second geared coupler 208. The oar assembly 100 further comprises at least one oar blade stopper 212 extending from the pair of brackets 206 and attached to the oar blade 210. The oar blade 210 is the part of the oar assembly 100 that facilitates the propulsion of the paddleboard 150 is the forward as well as the reverse direction. More specifically, in a first operative configuration of the oar assembly 100, the oar assembly 100 works as any other conventional oar to propel the paddle board in the forward direction, whereas in a second operative configuration, the second geared coupler 208 as well as the oar blade 210 are configured to move in hinged manner with respect to the movement of the shaft 202 and the first geared coupler, thereby allowing the user to propel the paddleboard in reverse direction. The first and second operative configurations are elaborately explained in the subsequent sections of the present disclosure.

Figure 3:
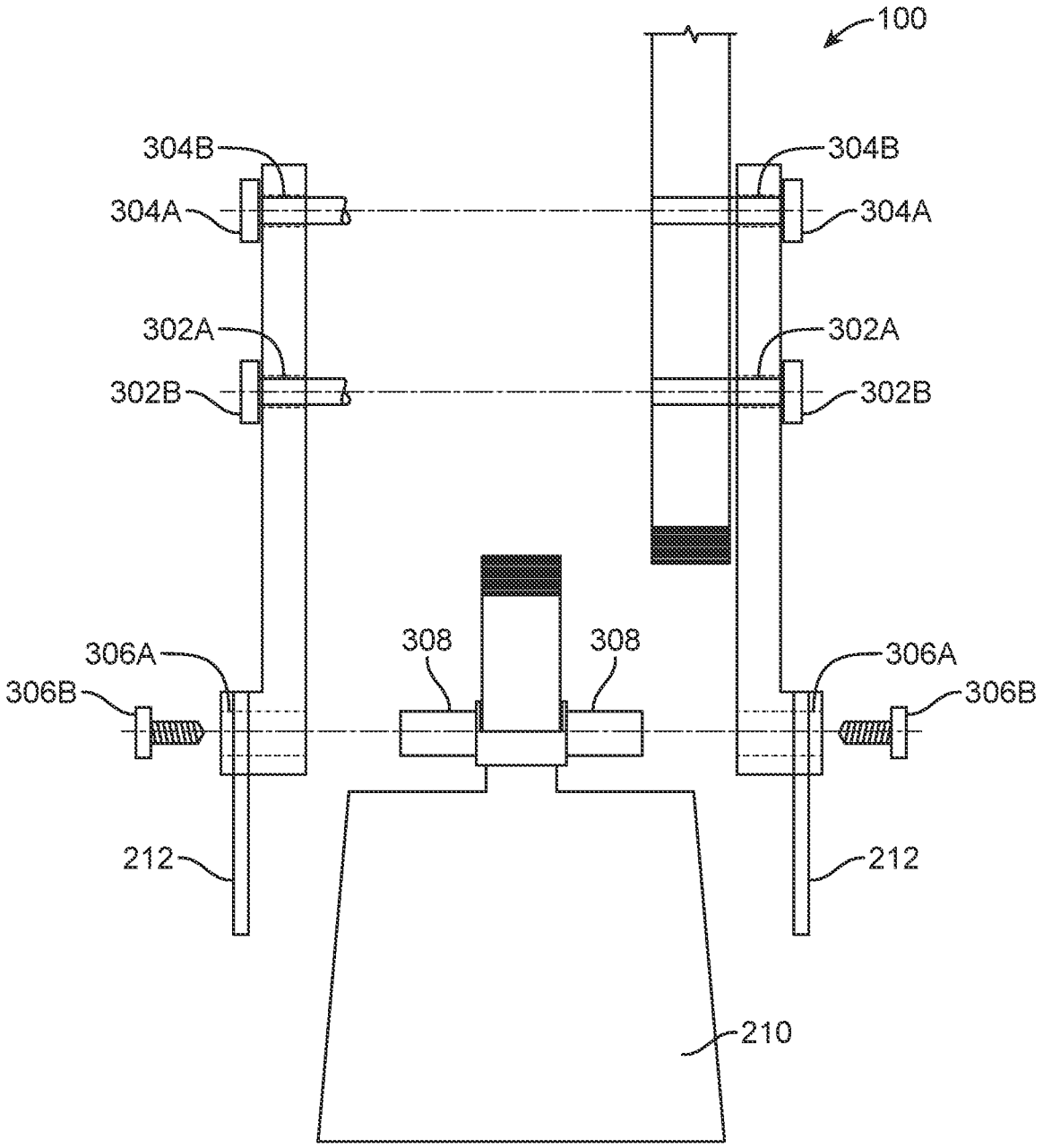
FIG. 3 illustrates a partial exploded view of the oar assembly, according to an embodiment of the present subject matter.

FIG. 3 illustrates a partial exploded view of the oar assembly, according to an embodiment of the present subject matter. Referring to FIG. 3, the oar assembly 100 further comprises a first hinged joint 302 configured between the first geared coupler 204 and the pair of brackets 206, wherein the first hinged joint 302 allows the hingeable movement between the first geared coupler 204 and the second geared coupler 208 to facilitate the operation of the oar assembly 100 in accordance with the first operative configuration. In another embodiment, the first hinged joint 302 may also be configured between the shaft 202 and the pair of brackets 206. In accordance with on embodiment of the present subject matter, the first hinged joint 302 may be a pin hinged joint comprising an aperture 302A and a hinge pin bolt 302B.

The oar assembly 100 further comprises a second joint 304 including a lock bolt 304A and an aperture 304B. The second joint 304 is configured between the shaft 202 and the pair of brackets 206. The placement of the lock bolt 304A in the aperture 304B locks the hingeable movement of the first geared coupler 204 with respect to the second geared coupler 208 to facilitate the operation of the oar assembly 100 in accordance with the second operative configuration.

The oar assembly 100 further comprises third joint 306 configured between the pair of brackets 206 and the second coupler 208, wherein the third joint 306 includes an aperture 306A and a screw 306B. The second geared coupler 208 includes a pair of laterally extending pins 308 to be received within the aperture 306A of the third joint 306 for facilitating hinged movement of the second geared coupler 208 in between the pair of brackets 206. In accordance with one embodiment, the pins 308 extend integrally from the second geared coupler. In another embodiment, the pins 308 are discreet components that may be assembled on the second geared coupler. The third joint 306 involves the usage of the screws 306B to facilitate snug fitment of the pair of laterally extending pins 308 within the aperture 306A.

Figure 4:
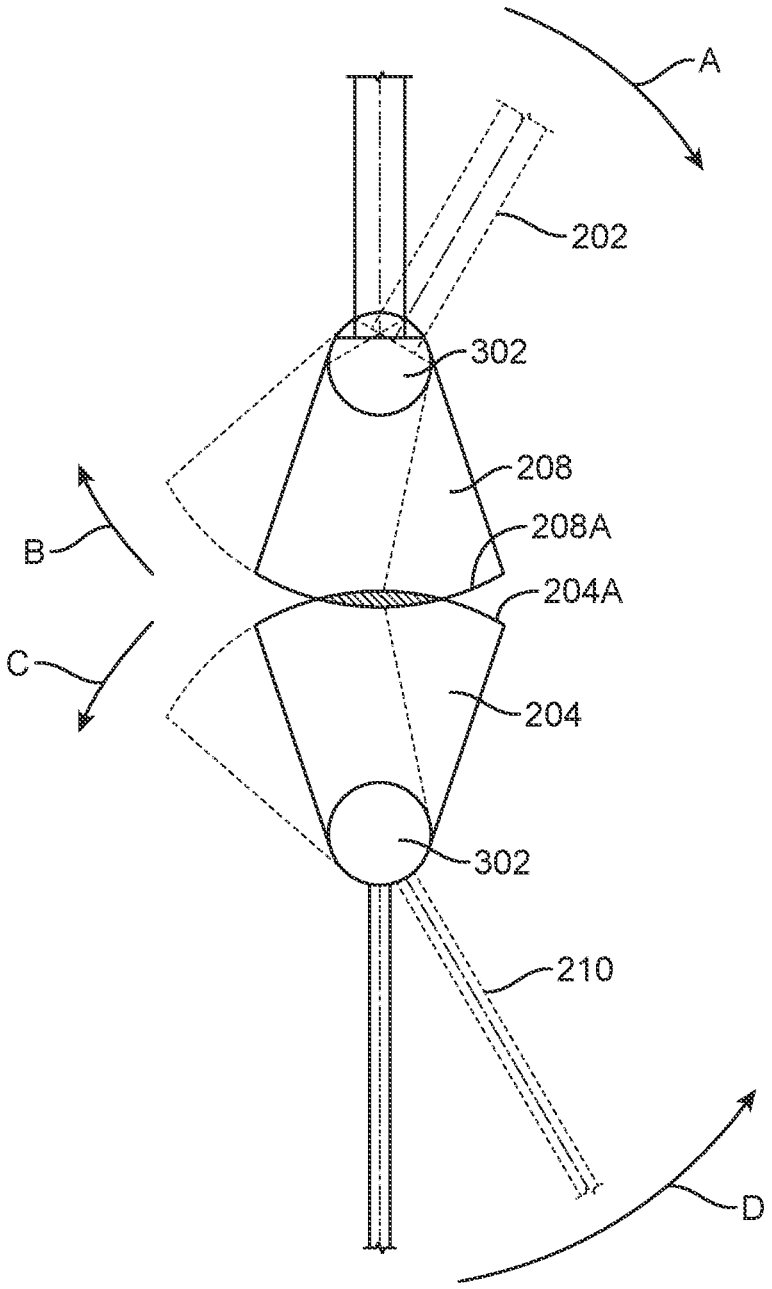
FIG. 4 illustrates a schematic view depicting the working of the oar assembly, according to an embodiment of the present subject matter.

The first operative configuration of the oar assembly 100 is hereinafter described with reference to FIG. 4, wherein FIG. 4 illustrates a schematic view depicting the working of the oar assembly, according to an embodiment of the present subject matter. It is to be noted that in the first operative configuration, the oar assembly 100 does not include the lock bolt 304A locked into the aperture 304B. In absence of the lock bolt 304A, the only form of mechanical coupling between the pair of brackets 206 and the first geared coupler 204 is facilitated by the first hinged joint 302, wherein the first hinged joint 302 is a hinged pin joint. Therefore, whenever the user moves the shaft 202 of the oar assembly in the direction depicted in FIG. 4 by arrow A, it causes the movement of the first geared coupler 204 in the direction depicted by arrow B in FIG. 4.

The movement of the first geared element 204 in the direction denoted by arrow B facilitates the movement of the second geared coupler 208 in an opposite direction denoted by arrow C in FIG. 4, which in turn facilitates the movement of the oar blade 210 in a direction denoted by arrow D in FIG. 4. As it can be seen from FIG. 4, the directions denoted arrows A and D are opposite of each other, which means that the direction of movement of the shaft is opposite to that of the oar blade 210. Such opposite movement of the oar blade 210 with respect to the shaft 202 facilitates the propulsion of the paddleboard in a reverse direction.

It can be understood that in the first operative configuration of the oar assembly 100, the movement of the shaft 202 is transmitted to the first geared coupler 204 via the first hinged joint 302. The movement of the first geared coupler 204 is then transmitted to the second geared coupler 208, and consequently to the oar blade 210 is a direction that is opposite to the direction of the movement of the shaft 202, thereby facilitating reverse propulsion of the paddleboard.

In the second operational configuration of the oar assembly 100, the oar assembly 100 includes the lock bolt 304A locked into the aperture 304B. The presence of the lock bolt 304A in the aperture 304B basically facilitates the transmission of the motion of the shaft 202 to the oar blade 210 via the pair of brackets 206 and the oar stoppers 212. In the second operational configuration, there is no hingeable movement at any of the first, second, or third joints, and the oar assembly 100 functions are any other conventional oar assembly used propel the paddleboard in the forward direction.

Therefore, it can be understood that in the second operative configuration of the oar assembly 100, the first and second geared couplers 204, 208 remain stationary and do not undergo hinged movements with respect to each other. The transmission of the movement of the shaft 202 to the oar blade 210 is facilitated by the pair of brackets 206 and the stoppers 212.

An advantageous aspect of the oar assembly 100, in accordance with an embodiment of the present subject matter, is the increased applicability of the oar assembly 100. More specifically, the oar assembly 100 can be used like a conventional oar to propel the paddleboard. The same oar assembly 100, subsequent to the easy and convenient removal of the lock bolt 304A from the aperture 304B facilitates the propulsion of the paddleboard in the reverse direction.

Another advantageous aspect of the oar assembly 100 is that the oar assembly 100 may be configured to usage on typical paddle boards, kayaks, and on any other water sport and boats. The oar assembly 100 may also be configured to usage either standing up or sitting down. All such configurations of the oar assembly 100 are obvious to those skilled in the art, and are therefore within the ambit of the present subject matter.

A person of ordinary skill in the art will recognize that various materials may be used to construct the various components, elements, and parts of an oar assembly in accordance with the present invention, including without limitation, plastics, metals, carbon fiber or graphite fiber materials, or any other materials suitable for submerging in water, and durable enough to withstand being placed in water as is typical with all water sports equipment for all types of water ways.

An oar assembly for a paddleboard has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching. It is intended that the scope of the invention not be limited by this detailed description, but by the claims and the equivalents to the claims.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the embodiments.

What is claimed is:

1. An oar assembly for a paddleboard, the oar assembly comprising:

a shaft having a top end and a bottom end;

a first geared coupler having a first toothed surface, the first geared coupler extending from the bottom end of the shaft;

a second geared coupler having a second toothed surface, the second geared coupler configured to couple to the first geared coupler;

an oar blade extending from the second geared coupler; and a pair of brackets configured for assembly on the shaft, the first geared coupler, and the second geared coupler;

wherein a meshing of the first toothed surface with the second toothed surface facilitates hingeable movement between the first geared coupler and the second geared coupler, and thereby between the shaft and the oar blade.

2. The oar assembly as claimed in claim 1, further comprising a first hinged joint configured between the first geared coupler and the pair of brackets, wherein the first hinged joint allows the hingeable movement between the first geared coupler and the second geared coupler.

3. The oar assembly as claimed in claim 1, further comprising a first hinged joint configured between the shaft and the pair of brackets, wherein the first hinged joint allows the hingeable movement between the first geared coupler and the second geared coupler.

4. The oar assembly as claimed in claim 2, further comprising second joint including a bolt and an aperture, the second joint configured between the shaft and the pair of brackets, wherein the placement of the bolt in the aperture locks the hingeable movement of the first geared coupler with respect to the second geared coupler.

5. The oar assembly as claimed in claim 1, further comprising a third joint configured between the pair of brackets and the second coupler, wherein the third joint includes an aperture and a screw.

6. The oar assembly as claimed in claim 5, wherein the second geared coupler includes a pair of laterally extending pins to be received within the aperture of the third joint for facilitating hinged movement of the second geared coupler in between the pair of brackets.

7. The oar assembly as claimed in claim 1, further comprising at least one oar blade stoppers extending from the pair of brackets and attached to the oar blade.

8. The oar assembly as claimed in claim 1, wherein the shaft and the first geared coupler are integral components.

9. The oar assembly as claimed in claim 1, wherein the shaft and the first geared coupler are discreet components that are assembled together.

10. The oar assembly as claimed in claim 9, wherein the assembly of the shaft with the first geared coupler is facilitated by one of fasteners and snap fit formations.

11. The oar assembly as claimed in claim 6, wherein the pair of laterally extending pins extend integrally from the second geared coupler.

12. The oar assembly as claimed in claim 6, wherein the pair of laterally extending pins is discreet component assembled on the second geared coupler.

13. The oar assembly as claimed in claim 1, wherein the oar assembly is made of at least one material selected from a group consisting of plastics, metals, carbon fiber, graphite fiber materials, or any other materials.

14. The oar assembly as claimed in claim 2 or 3, wherein the hingeable movement between the first geared coupler and the second geared coupler facilitates reverse propulsion of the paddleboard.

15. The oar assembly as claimed in claim 4, wherein locking the hingeable movement of the first geared coupler with respect to the second geared coupler facilitates the propulsion of the paddleboard in the forward direction.

* * * * *